US006551014B2

(12) United States Patent
Khieu et al.

(10) Patent No.: US 6,551,014 B2
(45) Date of Patent: Apr. 22, 2003

(54) RAISED PAVEMENT MARKER WITH IMPROVED LENS

(75) Inventors: Sithya S. Khieu, Eden Prairie, MN (US); Gregory E. Gilligan, Hastings, MN (US); Thomas R. Borden, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/778,331

(22) Filed: Feb. 7, 2001

(65) Prior Publication Data

US 2001/0048847 A1 Dec. 6, 2001

Related U.S. Application Data

(60) Provisional application No. 60/184,714, filed on Feb. 24, 2000.

(51) Int. Cl.[7] ..... E01F 9/08; G02B 5/124

(52) U.S. Cl. ..... 404/14; 404/12; 404/15; 404/16; 359/531

(58) Field of Search ..... 404/9, 10, 11, 404/14, 15, 16; 116/63 R; D10/113; 359/530, 531

(56) References Cited

U.S. PATENT DOCUMENTS

| | | | | |
|---|---|---|---|---|
| 1,591,572 | A | 7/1926 | Stimson | |
| RE24,906 | E | 12/1960 | Ulrich | 206/59 |
| 3,190,178 | A | 6/1965 | McKenzie | 88/82 |
| 3,332,327 | A | 7/1967 | Heenan | 94/1.5 |

(List continued on next page.)

FOREIGN PATENT DOCUMENTS

| | | | |
|---|---|---|---|
| CH | 629 899 | 5/1982 | G02B/5/124 |
| DE | 2 316 186 | 11/1973 | E01F/9/06 |
| WO | WO 97/27035 | 7/1997 | B29C/33/38 |
| WO | WO 97/45255 | 12/1997 | B32B/3/00 |
| WO | WO 98/03577 | 1/1998 | C08J/3/12 |
| WO | WO 98/24859 | 6/1998 | C09J/4/00 |
| WO | WO 98/24978 | 6/1998 | E01F/9/04 |
| WO | WO 99/48961 | 9/1999 | |
| WO | WO 99/54421 | 10/1999 | C09J/123/28 |
| WO | WO 99/66133 | 12/1999 | E01F/9/00 |

OTHER PUBLICATIONS

3M Technical Information 355—Scotch™ Superior Performance Box Sealing Tape, 3M 1999 (2 pp.).

3M Application Procedures for 3M™ Snowplowable Marker Series 190; 3M 1999 (1 p.).

3M Snowplowable Marker Series 190; 3M 1999 (1 p.).

3M Marker Series 290; 3M 1997 (2 pp.).

Paper entitled Market Test Specification for Durable, Abrasion–Resistant, Retroreflective Raised Pavement Marker—(3M™ Marker Series 290) Jul. 1998 (5 pp.).

(List continued on next page.)

*Primary Examiner*—Gary S. Hartmann
(74) *Attorney, Agent, or Firm*—James V. Lilly

(57) ABSTRACT

The present disclosure relates to improved raised pavement markers having a totally-internal-reflective lens. The disclosure also relates to methods of manufacturing the raised pavement marker. The raised pavement markers described below include a housing connected to a totally-internal-reflective lens. The totally-internal-reflective lens includes a retroreflective element having a smooth surface generally opposite a plurality of cube corner elements. A film is attached to the retroreflective element at the apexes of the cube corner elements to form spaces, i.e., an air gap, between the film and the cubes. The film and retroreflective element cooperate to form the totally-internal-reflective lens. Light entering the retroreflective element through the smooth surface is retroreflected at the cube/air interface. Methods of manufacturing include, for example, forming a shell with the retroreflective element and attaching the film to the apexes of the cube corner elements.

24 Claims, 6 Drawing Sheets

U.S. PATENT DOCUMENTS

| | | | | | |
|---|---|---|---|---|---|
| 3,409,344 | A | | 11/1968 | Balint et al. | 350/103 |
| 3,427,933 | A | | 2/1969 | Taylor-Myers | 94/1.5 |
| 3,627,403 | A | | 12/1971 | Hedgewick | 350/103 |
| 3,755,050 | A | | 8/1973 | Golden et al. | 161/2 |
| 3,784,279 | A | | 1/1974 | Hedgewick | 350/103 |
| 3,934,541 | A | | 1/1976 | May et al. | 116/63 |
| 3,971,623 | A | | 7/1976 | Hedgewick et al. | 350/103 |
| 4,025,159 | A | | 5/1977 | McGrath | 350/105 |
| 4,070,095 | A | | 1/1978 | Suhr | 350/103 |
| 4,248,748 | A | | 2/1981 | McGrath et al. | 260/27 |
| 4,415,615 | A | | 11/1983 | Esmay et al. | 428/40 |
| 4,555,161 | A | | 11/1985 | Rowland | 350/103 |
| 4,726,706 | A | | 2/1988 | Attar | 404/14 |
| 4,753,548 | A | * | 6/1988 | Forrer | 404/15 |
| 4,797,024 | A | * | 1/1989 | Forrer | 264/1.36 |
| 4,855,170 | A | | 8/1989 | Darvell et al. | 428/40 |
| 4,875,798 | A | | 10/1989 | May | 404/12 |
| 4,895,428 | A | | 1/1990 | Nelson et al. | 350/103 |
| 4,946,742 | A | | 8/1990 | Landin | 428/354 |
| 5,061,114 | A | | 10/1991 | Hedgewick | 404/14 |
| 5,117,304 | A | | 5/1992 | Huang et al. | 359/529 |
| 5,226,745 | A | | 7/1993 | Gartlacher | 404/14 |
| 5,277,513 | A | | 1/1994 | Flanagan et al. | 404/16 |
| 5,334,686 | A | | 8/1994 | Ando et al. | 526/307.7 |
| 5,340,231 | A | | 8/1994 | Steere et al. | 404/14 |
| 5,391,015 | A | | 2/1995 | Kaczmarczik et al. | 404/14 |
| 5,415,911 | A | | 5/1995 | Zampa et al. | 428/40 |
| 5,425,596 | A | * | 6/1995 | Steere et al. | 404/14 |
| 5,453,320 | A | | 9/1995 | Harper et al. | 428/356 |
| 5,612,136 | A | | 3/1997 | Everaerts et al. | 428/355 |
| 5,639,530 | A | | 6/1997 | Miron et al. | 428/40.1 |
| 5,667,335 | A | | 9/1997 | Khieu et al. | 404/14 |
| 5,677,050 | A | | 10/1997 | Bilkadi et al. | 428/331 |
| 5,677,376 | A | | 10/1997 | Groves | 525/73 |
| D386,706 | S | | 11/1997 | Khieu | D10/113 |
| 5,744,239 | A | | 4/1998 | Buccellato et al. | 428/411.1 |
| 5,784,197 | A | * | 7/1998 | Frey et al. | 359/529 |
| 5,820,988 | A | | 10/1998 | Nagaoka | 428/423.1 |
| 5,861,211 | A | | 1/1999 | Thakkar et al. | 428/343 |
| 5,897,271 | A | * | 4/1999 | Widmer | 404/1 |
| 5,898,523 | A | | 4/1999 | Smith et al. | 359/530 |
| 5,936,770 | A | | 8/1999 | Nestegard et al. | 359/530 |
| 5,981,032 | A | | 11/1999 | Smith et al. | 428/167 |
| 6,015,214 | A | | 1/2000 | Heenan et al. | 359/529 |
| 6,267,530 | B1 | * | 7/2001 | Attar | 404/14 |

OTHER PUBLICATIONS

Paper entitled Market Test Specification for Durable Abrasion–Resistant Snowplowable, Retroreflective Raised Pavement Markers (3M™ Snowplowable Raised Pavement Marker—Series 190) Jul. 1999 (6 pp.).

ASTM D 4280–96 Standard Specification for Extended Life Type, Nonplowable, Prismatic, Raised, Retroreflective Pavement Markers; pp. 438–444.

* cited by examiner

RAISED PAVEMENT MARKER WITH IMPROVED LENS

CROSS-REFERENCE TO RELATED APPLICATION

This application claims priority to U.S. Provisional Patent Application No. 60/184,714, filed Feb. 24, 2000.

BACKGROUND

Raised pavement markers are used as delineators for traffic lanes to alert drivers to roadway changes such as hills, curves, and exit ramps and to improve lane line guidance, especially at night or in poor driving conditions. Some of the many applications for raised pavement markers enable the identification of traffic lane separations, edge lines, fire hydrants, airport taxiways, and other special applications. Raised pavement markers often include a retroreflective lens attached to a marker body. In contrast to mirror-type (or specular) reflection, a retroreflective lens returns light generally directly back to its source. A retroreflective lens appears brightest to observers near the light source—a driver and vehicle headlights, for example. This is true for drivers at almost any viewing angle, which makes retroreflective lenses excellent for night visibility. Two common retroreflective lenses used in raised pavement markings include vacuum-metallized retroreflective lenses and totally-internal-reflective lenses.

The vacuum-metallized retroreflective lens is a cube corner prismatic element having a mirror-like metallic surface deposited directly on the surface of the prismatic element. The cubes and mirror-like surface retroreflect light from a headlamp back to the driver of the vehicle. The direct labor and materials used to make this type of lens are relatively inexpensive, but manufacture requires an initial purchase for expensive deposition equipment to form the mirror-like surface. The mirror-like surface absorbs some of the light. Also, moisture that seeps into the lens can corrode the mirror-like surface that further reduces efficiency.

Another type of retroreflective lens is the totally-internal-reflective lens that includes a rigid backing spaced-apart from and behind the cube corner prismatic element to create a hermetically-sealed air gap between the prismatic element and the backing. Under the principles of physics, the refractive index of the prismatic element is chosen such that the air gap causes light entering the prism to be totally and internally retroreflected at the prism—air gap interfaces. Totally-internal-reflective lenses are extremely efficient retroreflective articles. Totally-internal-reflective lenses, however, are often more expensive and difficult to manufacture than vacuum-metallized retroreflective lenses. The rigid backing is often ultrasonically welded or thermally sealed directly to the prismatic elements forming septa that provide for the hermetically sealed air gaps. Generally, totally-internal-reflective lenses are more expensive than their vacuum-metallized counterparts.

Many communities purchase raised pavement markers based on value, i.e., they choose the appropriate raised pavement marker based on a desired performance for a given application. For some communities, however, value must take a back seat to low cost. Because of budgets or other reasons, these communities must settle for low cost markers even when a traffic application demands a better performing marker. Of course, traffic safety is a general human concern and effects everyone. Thus, there exists a need for a low cost, high performance raised pavement marker.

SUMMARY

The present disclosure relates to improved raised pavement markers having a totally-internal-reflective lens. The disclosure also relates to methods of manufacturing the raised pavement marker. The raised pavement markers described below include a housing connected to a totally-internal-reflective lens. The totally-internal-reflective lens includes a retroreflective element having a smooth surface generally opposite a plurality of cube corner elements. A film is attached to the retroreflective element at the apexes of the cube corner elements to form spaces, i.e., an air gap, between the film and the cubes. The film and retroreflective element cooperate to form the totally-internal-reflective lens. Light entering the retroreflective element through the smooth surface is retroreflected at the cube/air interface. Methods of manufacturing include, for example, forming a shell with the retroreflective element and attaching the film to the apexes of the cube corner elements.

The raised pavement markers disclosed below include several advantages over other markers, and some of these advantages are described below. One of the advantages is that the markers are high performance but manufactured at a relatively low cost. For example, the totally-internal-reflective lens can be manufactured without septa. Septa, as described above, reduce the surface area that is available for retroreflection. Further, the raised pavement markers disclosed below are significantly more retroreflecting than vapor coated lenses. In a recent laboratory analysis, the retroreflective luminous intensity (measured in millicandellas per lux, or mcd/lx) was found to be 1349 mcd/lx for the markers described below and 487 mcd/lx for the vapor coated lens, each measured with a horizontal entrance angle of zero degrees, an observation angle of 0.2 degrees and a rotational angle of zero degree (in accordance with ASTM-D 4280-96). Likewise, the retroreflective luminous intensity was found to be 849 mcd/lx for the markers described below and 303 mcd/lx for the vapor coated lens, each measured with an entrance angle of twenty degrees, an observation angle of 0.2 degrees and a rotational angle of zero degree (in accordance with ASTM-D 4280-96).

DETAILED DESCRIPTION

The disclosure relates to raised pavement markers with an improved lens. The disclosures, including the figures, describes the raised pavement markers with reference to a few examples. The scope of the invention is not limited to the few examples, i.e., the described embodiments of the invention. Rather, the scope of the invention is defined by the appended claims. Changes can be made to the examples (including alternative designs not disclosed) so as to still fall within the scope of the claims.

Figure 1:
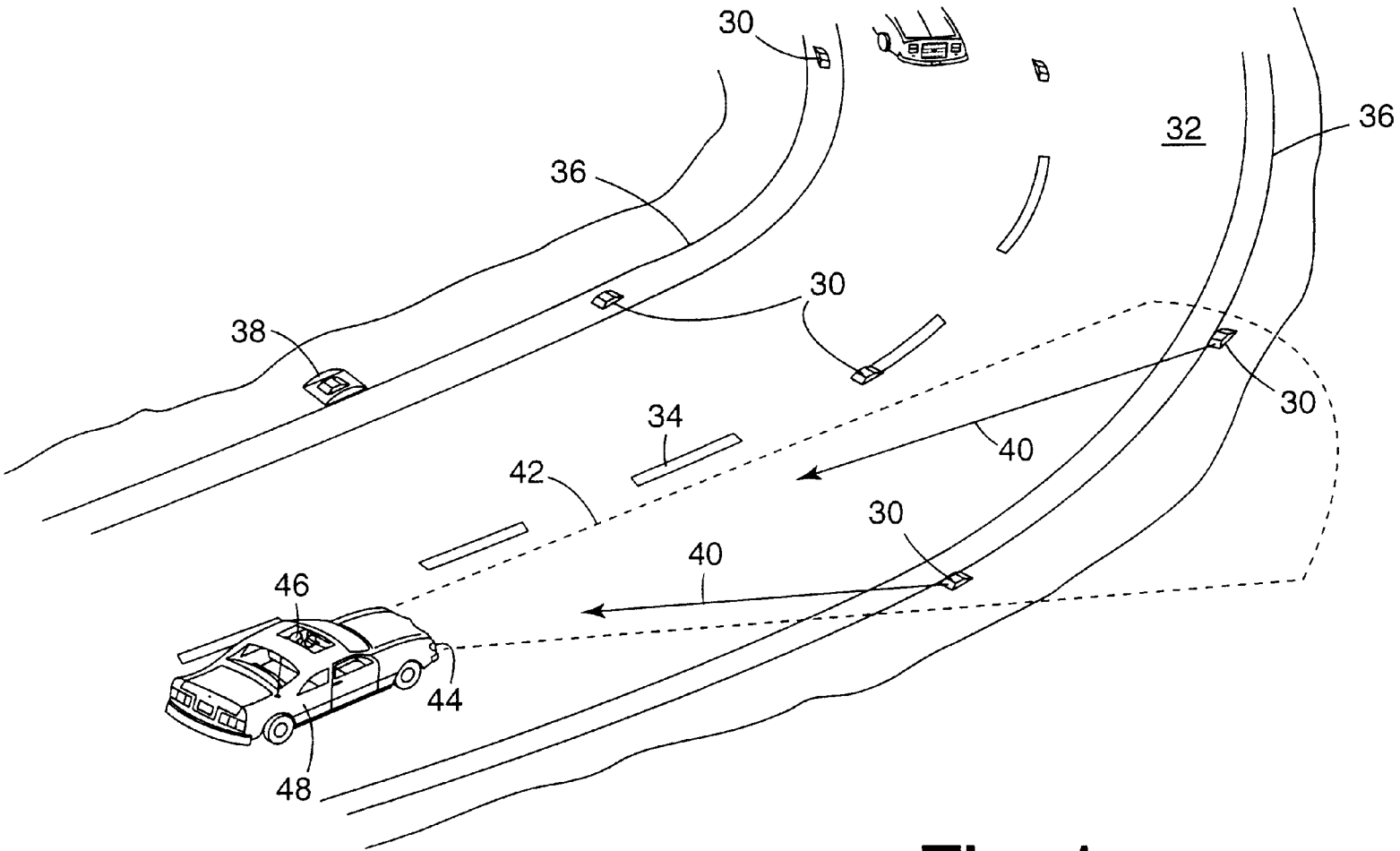
FIG. 1 shows a perspective view of a common application for a few examples of raised pavement markers.

FIG. 1 shows a perspective view of one example of a common application for a few versions of raised pavement markers. The raised pavement markers 30 in the example are attached to the road surface 32 to enhance pavement markings such as traffic lane skip lines 34 and edge lines 36. In one example, raised pavement markers 30 are attached to asphalt or concrete road surfaces with a special adhesive. In another example, the raised pavement markers include a cast iron housing (protector) 38 to protect the raised pavement marker from damage, for example from snow plows. The cast iron housing (protector) 38 is partially buried in the road surface. The markers 30 yield high intensity retroreflected light 40 when illuminated 42 by vehicle headlights 44 (one source of light). The retroreflected light is seen by the driver 46 because of the driver's relative proximity to the headlights 44. In addition to providing a visual alert, the raised pavement markers cause the vehicle 48 to produce a "rumble" sound when the vehicle tires cross the markers and give the driver 46 an audible warning.

Figure 2:
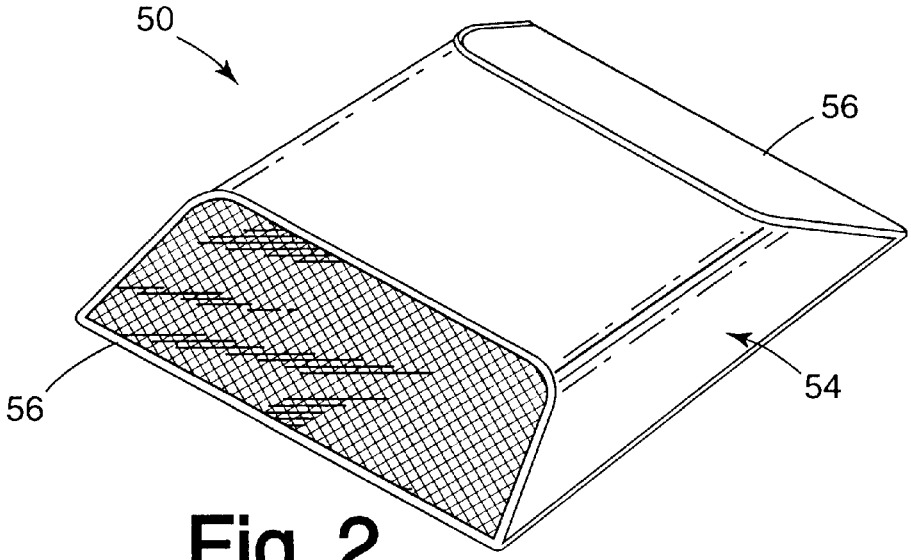
FIG. 2 shows a perspective view of an example of a raised pavement marker shown in FIG. 1.
Figure 3:
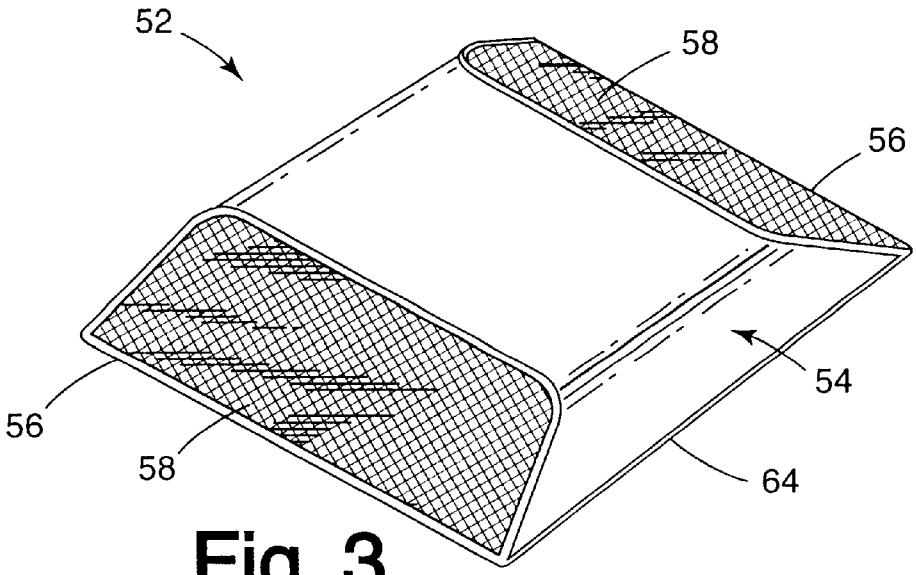
FIG. 3 shows a perspective view of another example of a raised pavement marker shown in FIG. 1.
Figure 4:
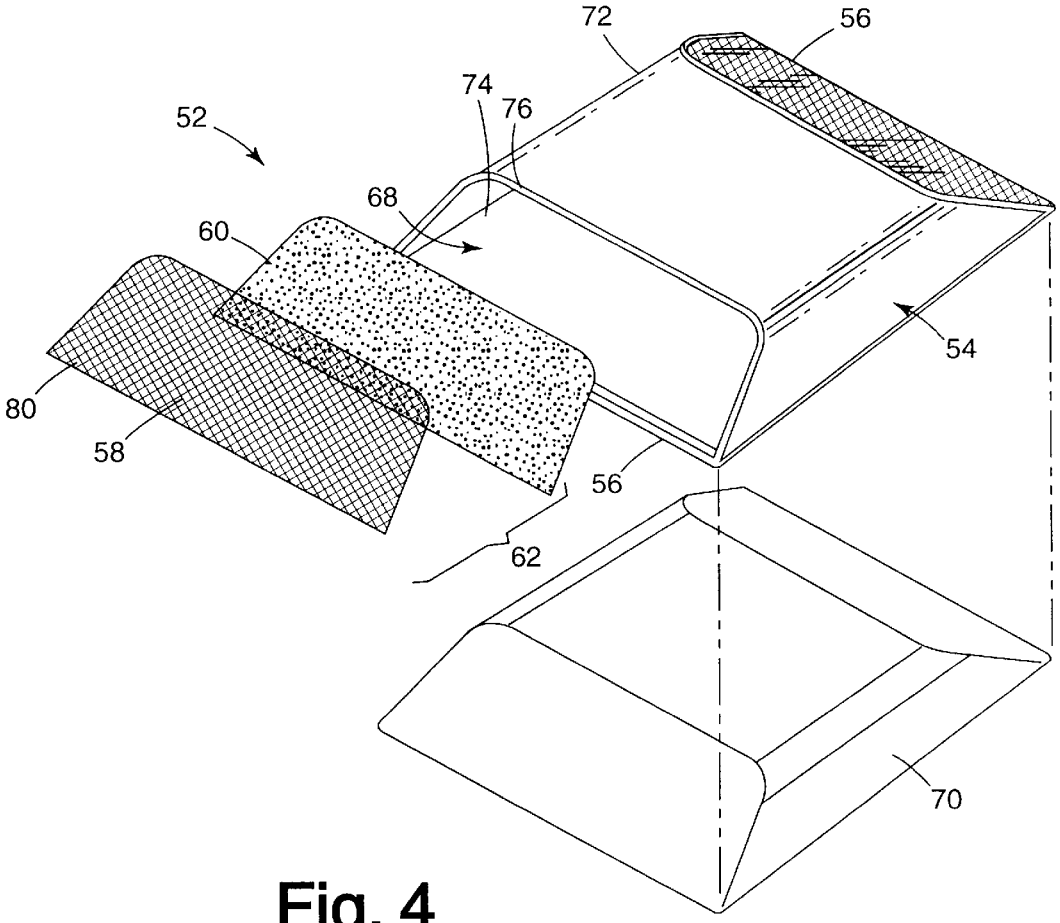
FIG. 4 shows an exploded view of the marker of FIG. 2.

FIGS. 2 and 3 show perspective views of two examples of raised pavement markers 50, 52 shown generally as markers 30 in FIG. 1. FIG. 4 shows a partially exploded view of marker 52 of FIG. 3. In the examples, like elements of the markers 50, 52 are labeled with like reference numbers in the figures and description. Each marker 50, 52 includes a housing 54 with sides 56. At least one side 56 includes a retroreflective element 58. Marker 50 is known as a one-way marker, and marker 52 is known as two-way marker. Specifically, marker 50 includes one side with a retroreflective element 58, and marker 52 includes two sides 56 that are generally opposite each other on the housing 54 where each of the two sides 56 includes a retroreflective element 58. A film 60 contacts the retroreflective element 58 to form a generally enclosed air gap and provide a totally-internal-reflective lens 62. One-way markers 50, with one totally-internal-reflective lens 62 are useful in marking edge lines 36 and, often, ramp lines where the light to be retroreflected originates from a single direction of traffic. Two-way markers 52 with two totally-internal-reflective lenses 62 are useful for marking traffic lane skip lines 34 where the light to be retroreflected originates from opposing directions of traffic. Additionally, the housing 54, the retroreflective element 58 or both can be colored to match traffic markings.

Housings 54 can be constructed of various shapes, sizes, or materials depending on the application or intended use. In one example, a housing includes a base surface 64 suitable for attachment to the road surface 32 via an adhesive or other connector. The markers can also include finger grips (not shown) for ease in placement and handling of the markers 50, 52. Depending on the application, the housing includes one or more sides 56 with a receiving area 68. In the example, each receiving area 68 is inclined from an angle that is perpendicular to the base 64. Typically, the angle is about 45 to 75 degrees from the perpendicular (or, 15 to 45 degrees from the base surface 64). In the example shown, the angle is about 60 degrees from the perpendicular. The inclined receiving areas 68 provide a ramp to reduce impact to tires and provide a receiving area that enables the totally-internal-reflective lens 62 to be optimally positioned for use.

Housing 54 is able to withstand common impact, and be constructed in various forms. For example, the housing 54 can be made solid where the totally-internal-reflective lens 62 is attached to a side 56 with receiving area 68, i.e., attached to the housing 54 on top of the receiving area 68. The receiving area 68 can be planar (smooth) or textured. In the example shown in FIG. 4, the housing 54 includes a filler 70 inside of a concave shell 72. The filler 70 can include a potting compound, or potting mixture, now known in the art. Also, the filler 70 can include a molded rib base, also known in the art. Other fillers 70 are contemplated. In the example shown in FIG. 4, the shell 72 is concave and at least partially encloses the filler 70. The filler 70 provides a large portion of the base surface 64. In the example, the shell 72 also provides the sides 56 and receiving area 68. The receiving area 68 includes an aperture 74 surrounded by a frame 76. The totally-internal-reflective lens 62 is connected to the receiving area 68 where part of the lens 62 is disposed within the aperture 74 and connected to the frame 76, for example by an adhesive. In still another example, described in more detail below with FIGS. 8–10, the receiving area includes an integrally formed retroreflective element 58.

Figure 5:
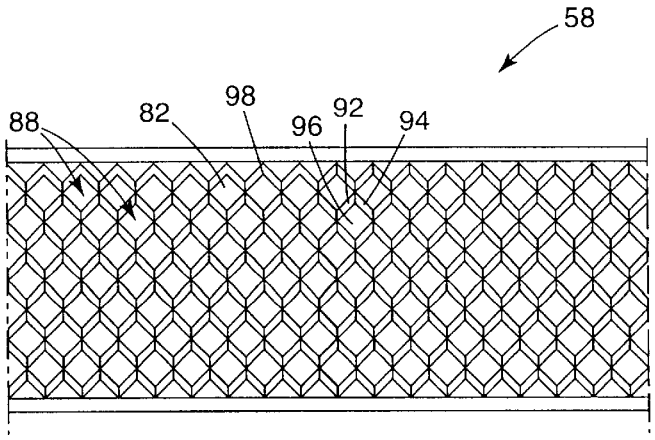
FIG. 5 shows a portion of a totally-internal-reflective lens that is a portion of the marker of FIG. 1.

FIGS. 4 and 5 show the totally-internal-reflective lens 62 with the retroreflective element 58 having a viewing surface 80 opposite a structured surface 82. A light incident on the viewing surface 80 passes through the retroreflective element 58 and is retroreflected at the structured surface 82 back to the light source. In one example, the element 58 is integrally formed into the sides 56 of the housing 54 and is therefore made from the same material as the shell 72. In the example shown, the element 58 is made from a material that is different than the material used for the housing 54. The materials are selected to optimize the performance of the housing 54 and the element 58, and the element 58 is attached to the housing 54. The retroreflective element 58 is formed of a material that is substantially transparent and is dimensionally stable, durable, weatherable, and readily formable into a desired configuration. In one example, the element 58 is generally rigid. One example of a material used to form element 58 is acrylic such as Plexiglas brand resin available from Rohm and Haas.

The viewing surface 80 faces outwardly toward the environment in a raised pavement marker 50, 52. The viewing surface 80 in the example is generally smooth, or generally planar, in order to reduce diffusion of the light incident on the surface 80. In one example, the retroreflective element also includes an abrasion-resistant coating 82 or an overlay in order to reduce damage or wear. In the example, the retroreflective element 58 is formed in layers and of dissimilar materials. For example, a ceramer coating imparts abrasion resistance to the viewing surface 80. Other examples include a single piece element 58.

The structured surface 82 includes a plurality of cube corner elements 88, also known as prisms, triple mirrors, or other terms used in the art. As shown in FIG. 5, each cube corner element 88 is generally a structure having three mutually substantially perpendicular surfaces 92, 94, 96 (optical faces) that cooperate to retroreflect incident light. The optical faces intersect at an apex 98. Thus, a plurality of apexes 98 protrude from the retroreflective element 58 on the structured surface 82. Cavities 100 are formed between the perpendicular surfaces 92, 94, 96. Each cube corner element 88 also has an optical axis 102, which is the axis that extends through the cube corner apex 98. Cube corner elements 88 where the optical axis 102 deviates from a normal to the plane of the retroreflective element 58 are called "canted cube corner elements." In the example shown, the cube corner elements 88 are canted at an angle of about 60 degrees. For performance considerations, cube corner elements can be canted to correspond with the angle of incline of the receiving area 68.

Many examples of configurations of cube corner elements 88 are contemplated. In the example shown, the cube corner elements are known in the art as "full cubes" as opposed to truncated cubes, which can also be used. Full cubes are often molded into shape. In one example, truncated cubes are generally made by ruling or scribing 3 grooves at 120 degrees to each other on a flat surface, with intersection points of the 3 lines forming groove angles of 60 degrees. Many different styles of truncated cubes are known in the art. Also, the size of the cube corner elements 88 is generally inconsequential. The example shows macrocubes (cubes with an optical axis 102 height of greater than 10 mm), but microcubes (less than 10 mm) can also be used.

Figure 6A:
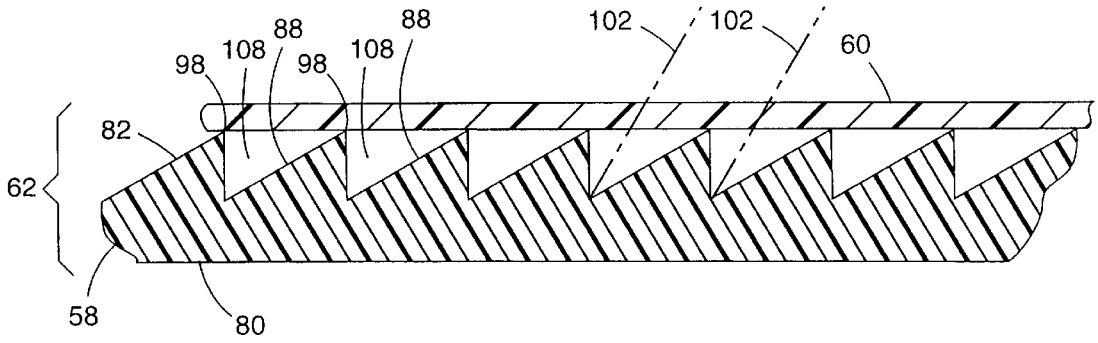
FIGS. 6*a–c* shows a cross section of a portion of one of each of examples of a totally-internal-reflective lens that is a portion of the markers of FIG. 1.

The film 60 is connected to the structured surface 82 at the apexes 98 such that a portion of the cube corner elements 88 are spaced apart from the film 60 to form the totally-internal-reflective lens 62. FIG. 6*a* shows a cross section of one example of the totally-internal-reflective lens 62 with the film 60 connected to the structured surface 82. Ideally, the film 60 touches the structured surface 82 only at the points that are the apexes 98. Practically, however, this is difficult—the film 60 often also touches part of the perpendicular surfaces 94, 96, 98 at places around the points that are the apex. The apex 98 can also be rounded due to manufacturing tolerances. Even if the apexes 98 "sink into" the film 60, a portion of the cube corner elements 88 still do not touch the film 60 and, thus, are spaced apart from the film 60. The amount of the portion of the cube corner elements that touches the film can vary, but in the example shown, the film 60 contacts the cube corner elements 88 as little as necessary to hold the film in place. Air gaps 108 are created between the film 60 and the non-touching portions of the cube corner element 88 that cooperate to form the totally-internal-reflective lens 62.

The film 60 selected for this invention is sufficiently flexible so as to be foldable around the periphery of a retroreflective element 58 and yet is sufficiently stiff so as not to be pressed against the surfaces 94, 96,98 of the cube corner elements 88. In manufacturing the film strength is preferably strong enough to support the pressure during potting of mixtures, including those containing binders such as epoxies, for the duration of the time and temperature cycle required to cure the binder. If the film 60 is too flexible, the potting pressure on the binder will push the film 60 against too much of the surfaces 94, 96, 98. The film 60 provides an air gap for the faces of the cube. The film can provide color appearance to the lens 62, seal out dirt and water, and provide design flexibility and providing a cushion to absorb the impact of tires on the lens. In the examples shown, the film 60 has a thickness between about 0.001 mm and about 1 cm, and more specifically between about 0.01 mm and about 1.6 mm. In general, the thicker the film, the less flexible the film but with more ability to absorb impact of tires on the lens. Conversely, in general, decreasing the thickness of the film tends to make the film more flexible or foldable.

Some illustrative examples of materials for the films 60 include thermoplastic, heat-activated, ultraviolet cured, and electron beam cured polymer systems. Suitable films have been found to include those generally used as backings and carriers for various articles, such as the adhesive tapes. Thus the composition of the films include polyvinyl chlorides, polyesters, polyethylenes, polypropylenes, polyurethanes, fluoropolymers, acrylics, and various combinations thereof. The films selected may also be multilayer.

Many examples of suitable films 60 exist, and listed below are but a few of such examples. Urethane polymers for use as films include MORTHANE thermoplastic polyurethane polymers from Morton, including polycaprolactone based aliphatic thermoplastic polyurethanes such as MORTHANE PN03-214, and polyester based aliphatic thermoplastic polyurethanes such as MORTHANE PN343-101, PN343-200, PN343-201, PN343-203, and PN3429-105. Copolymers of ethylene with vinyl acetate for use as films include ELVAX resins from DuPont and copolymers of ethylene and vinyl acetate. ULTRATHENE high ethylene vinyl acetate copolymers from Quantum/Equistar. Ethylene methyl acrylate copolymers for use in films of the present invention include EMAC and EMAC+ resins from Chevron. Natural and artificial rubbers, such as a terpolymer (EPDM) composed of three components, e.g., ethylene, propylene, and diene, can be used in applications where the films absorb the impact of tires on the lens. Films comprising air cells or bubbles and "foam tapes" can also be used to absorb the impact of tires on the lens.

Figure 6B:
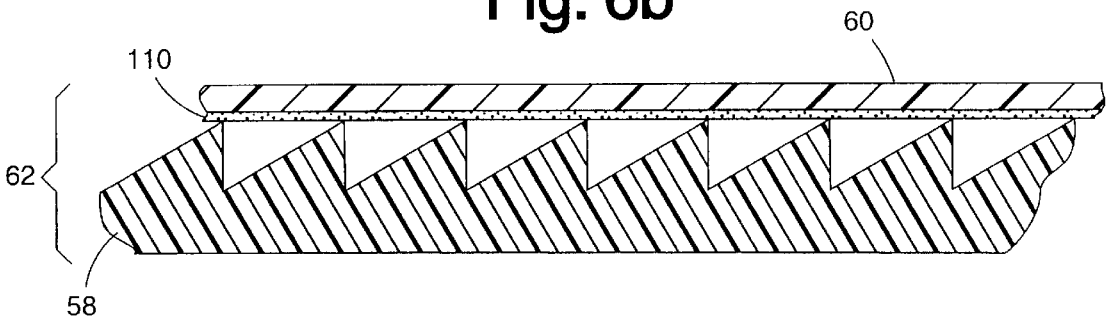
Figure 6C:
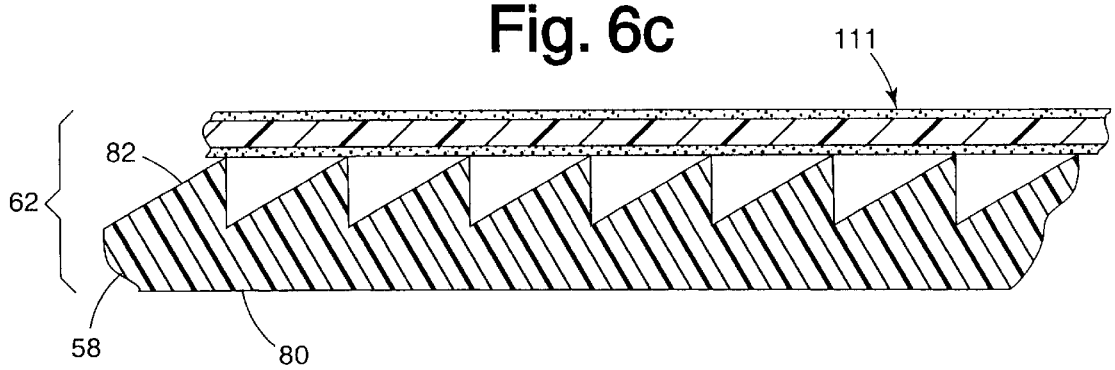

In the example shown in FIG. 6*b,* the film 60 is attached to the retroreflective element 58 with an adhesive. In one example, the film includes an adhesive layer 110, such as a pressure sensitive adhesive layer. In another example, the film 60 is a piece of adhesive tape. Adhesive tapes identified as product numbers SCOTCH brand 355, 845 book tape, 471, and 4101DSL002AC91130, all commercially available from 3M are useful as films 60. More specifically, SCOTCH brand 355 box sealing tape is a pressure sensitive hot melt rubber-resin adhesive layer on a polyester backing layer. The rubber-resin PSA layer adheres to many surfaces and provides reliable closures, and the polyester backing layer is strong and tear resistant. As shown in FIG. 6*c* a two-sided adhesive film 111 can be used to form the totally-internal-reflective lens 62 and attach the lens 62 to the housing 54, when solid, to the top of the receiving area 68.

In one example, the film 60 is pressed onto the apexes 98 of the structured surface 82 of the retroreflective element 58 to form the totally-internal-reflective-lens 62. One example has the film 60 having a size slightly larger than and in the shape similar to a periphery of the retroreflective element 58. Thus, the film 60 can be folded around the periphery of the retroreflective element 58 to help isolate the air gaps 108 from the environment. In another example, the film 60 is the same size and in the same shape as the retroreflective element 58. The film 60 may be either pre-stretched or stretched so that the film 60 is free of wrinkles and remains flat. The film can be attached to the retroreflective element in many ways. For example, when the film 60 includes a pressure sensitive adhesive layer, it can be pressed against the retroreflective element 58 with rubber rollers. Another way is to use a film 60 having a chemical composition thermally compatible with a chemical composition of the retroreflective lens, and then to thermally seal the film 60 to the apexes of the structured surface 88. A third way is to ultrasonically seal the film 60 to the apex 98 of the structured surface 88. This is a short list of examples on how to create the totally-internal-reflective lens, and other examples should become apparent to those skilled in the art.

Many ways exists to form the raised pavement markers, and a few are discussed below. In these examples, the shell 72 is formed having a retroreflective element 58 where the film 60 is attached to the structured surface 82 of the retroreflective element 58. These examples can be used for both on-way and two-way raised pavement markers 50, 52.

Figure 7:
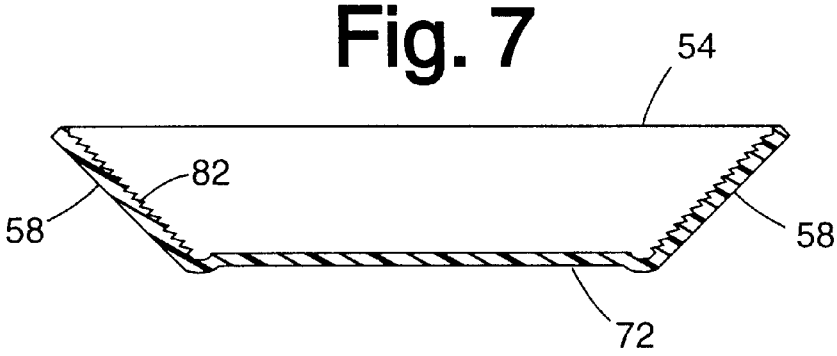
FIGS. 7–9 show stages of the raised pavement marker of FIG. 1 during one example of manufacturing.
Figure 8:
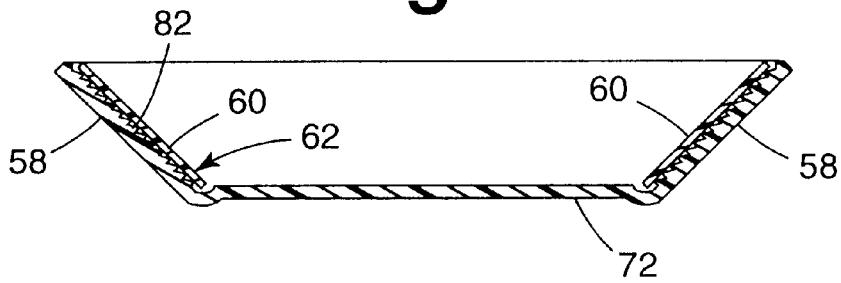
Figure 9:
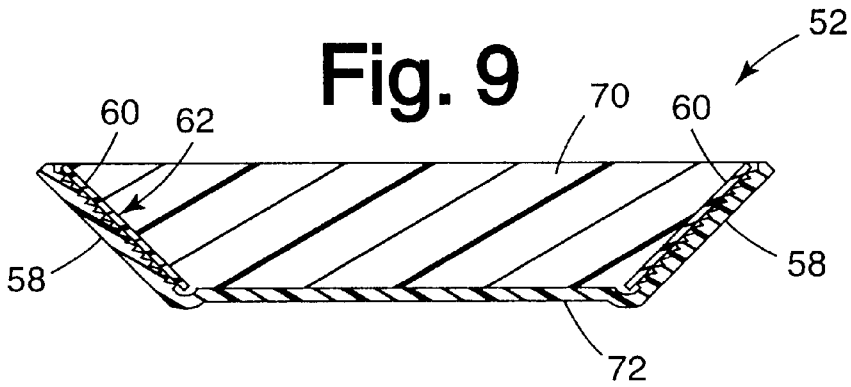

FIGS. 7–9 show the manufacturing of the raised pavement marker where the retroreflective element 58 is integrally formed with the shell. FIG. 7 shows the shell 72 integrally formed with the retroreflective element 58. In one example, the shell 72 is injection molded to form the unitary piece structure. Other ways of forming or molding the shell, however, are contemplated. FIG. 8 shows the film 60 is placed on the structured surface 82 of the retroreflective element to form the totally-internal-reflective lens 62. FIG. 9 shows the shell with the film in place filled with a filler 70.

Figure 10:
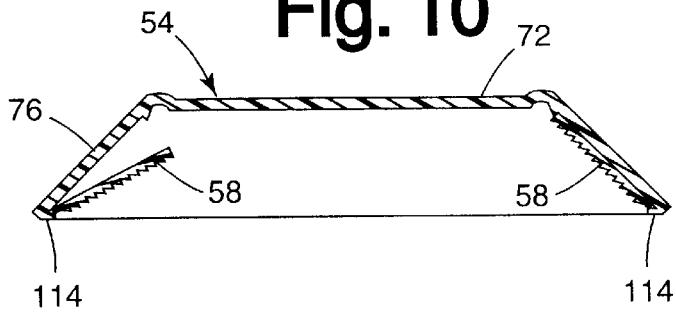
FIGS. 10–11 show stages of the raised pavement marker of FIG. 1 during another example of manufacturing.
Figure 11:
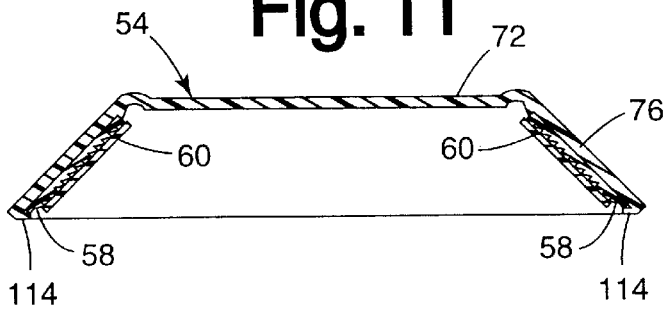

FIGS. 10–11 show the manufacturing of the raised pavement marker where the retroreflective element 58 is attached to the shell 72. In the example shown in FIG. 10, the shell 72 can be formed with tabs 114 that can be used to hold the retroreflective element 58 in place. In this example, the shell 72 is injection molded. After the shell 72 is molded, the retroreflective element 58 is attached to the shell from the inside and adhered to the frame 76 of the shell 72, as shown in FIG. 11. The film 60 can be attached to the retroreflective element 58 before or after the retroreflective element 58 is inserted into the shell 72. Subsequently, a filler 70 is placed inside the shell 72.

Figure 12:
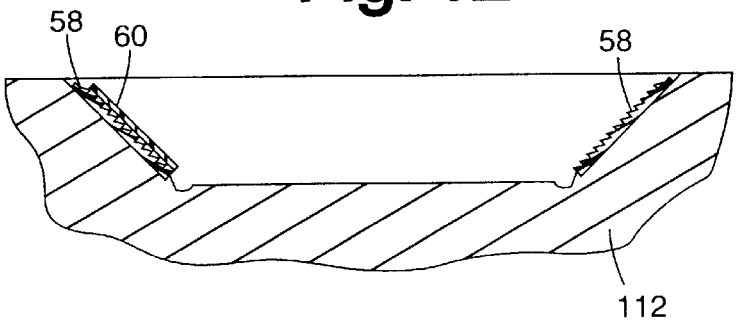
FIGS. 12–13 show stages of the raised pavement marker of FIG. 1 during another example of manufacturing.
Figure 13:
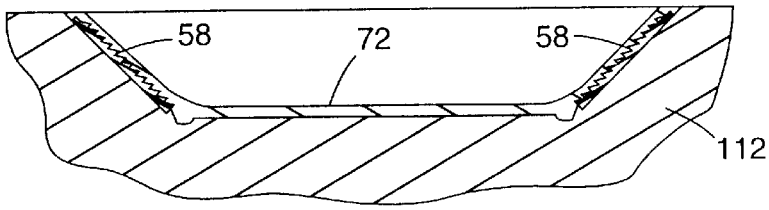

FIGS. 12–13 show the manufacturing of the raised pavement marker where the shell 72 is injection molded around the retroreflective element 58. FIG. 12 shows a retroreflective element placed inside the mold 112 for a shell 72. The retroreflective element 58 can include an attached film 60, or the film 60 can be attached sometime prior to adding a filler 70. With the retroreflective element 58 in place in the mold 112, the shell is injection molded so it is attached to the retroreflective element 58, as indicated in FIG. 13. If the film 60 was not attached prior to molding, the film 60 is now attached to the retroreflective element 58, and a filler 70 is added to the shell 72.

What is claimed is:

1. A raised pavement marker, comprising:

a housing having at least one side that is a retroreflective element, wherein the retroreflective element includes a generally smooth surface opposite a structured surface, the structured surface having a plurality of cube corner elements with three generally mutually perpendicular surfaces, the perpendicular surfaces of the cube corner elements forming a plurality of apexes protruding from the retroreflective element; and a film attached to the structured surface at at least some of the plurality of apexes such that at least a portion of the cube corner elements are spaced apart from the film to form a totally-internal-reflective lens.

2. The raised pavement marker of claim 1 wherein the retroreflective element is integrally formed with the housing.

3. The raised pavement marker of claim 1 wherein the housing and retroreflective element are formed of different materials and the totally-internal-reflective lens is attached to the housing.

4. The raised pavement marker of claim 1 wherein the housing includes two opposing sides and wherein each opposing side includes a retroreflective element formed into a totally-internal-reflective lens.

5. The raised pavement marker of claim 1 wherein the housing is filled with a potting mixture.

6. The raised pavement marker of claim 1 wherein generally all of the apexes contact the film.

7. A raised pavement marker, comprising:

a housing having a base surface and at least one side having a receiving area, wherein the side is inclined from an angle that is perpendicular to the base;

a totally-internal-reflective lens connected to the housing at the receiving area, the totally-internal-reflective lens having a retroreflective element connected to a film, wherein the retroreflective element includes a generally planar surface opposite a structured surface, the structured surface having a plurality of cube corner elements, each cube corner element having three generally mutually perpendicular surfaces, the perpendicular surfaces of the cube corner elements forming a plurality of apexes protruding from the retroreflective element; and a flexible film contacting the structured surface at the plurality of protruding apexes such that at least a portion of each of the cube corner elements are spaced apart from the film to form gaps between the film and the portions of the cube corner elements.

8. The raised pavement marker of claim 7 wherein the housing includes a generally concave shell such that the at least one side and receiving area are formed on the shell.

9. The raised pavement marker of claim 8 wherein the receiving area includes an aperture, and at least a portion of the totally-internal-reflective lens is disposed within the aperture.

10. The raised pavement marker of claim 9 wherein the aperture includes a rim and the totally-internal-reflective lens is adhered to the rim.

11. The raised pavement marker of claim 8 wherein the generally concave shell is filled with a potting material to form the housing.

12. The raised pavement marker of claim 8 wherein the cube corner elements of the retroreflective element are canted cubes.

13. The raised pavement marker of claim 7 wherein the housing includes a planar receiving area wherein the totally-internal-reflective lens is attached to the housing on top of the receiving area.

14. The raised pavement marker of claim 7 wherein the film includes a backing and an adhesive, and the adhesive contacts the cube corner elements at the adhesive.

15. The raised pavement marker of claim 7 wherein the housing includes a plurality of receiving areas, and wherein one totally-internal-reflective lens is connected to each receiving area.

16. A method of making a raised pavement marker, comprising:

forming a shell having a retroreflective element, wherein the retroreflective element includes a generally smooth surface opposite a structured surface, the structured surface having a plurality of cube corner elements with three generally mutually perpendicular surfaces, the perpendicular surfaces of the cube corner elements forming a plurality of apexes protruding from the retroreflective element; and attaching a film to the structured surface at at least some of the plurality of apexes such that at least a portion of the cube corner elements are spaced apart from the film to form a totally-internal-reflective lens.

17. The method of claim 16 wherein the shell is injection molded.

18. The method of claim 17 wherein the shell is injection molded around the retroreflective element.

19. The method of claim 18 wherein the film is attached to the retroreflective element before the shell is molded around the retroreflective element.

20. The method of claim 17 wherein the retroreflective element is attached to the shell after the shell is injection molded.

21. The method of claim 20 wherein the film is attached to the structured surface of the retroreflective element before the retroreflective element is attached to the shell.

22. The method of claim 16 wherein the retroreflective element is integrally formed with the shell.

23. The method of claim 16 wherein the shell is filled with a potting compound after the film is attached to the structured surface of the retroreflective element.

24. The method of claim 16 wherein the retroreflective element is attached to the shell after the shell is formed.

* * * * *